US008997532B2

(12) United States Patent
Atkinson

(10) Patent No.: US 8,997,532 B2
(45) Date of Patent: Apr. 7, 2015

(54) WASHING MACHINE BRUSH SYSTEM AND METHOD

(76) Inventor: Gregg M. Atkinson, Sartell, MN (US)

( * ) Notice: Subject to any disclaimer, the term of this patent is extended or adjusted under 35 U.S.C. 154(b) by 1055 days.

(21) Appl. No.: 13/051,432

(22) Filed: Mar. 18, 2011

(65) Prior Publication Data

US 2012/0234053 A1 Sep. 20, 2012

(51) Int. Cl.

| | |
|---|---|
| ***D06F 37/00*** | (2006.01) |
| ***D06F 35/00*** | (2006.01) |
| ***D06F 39/12*** | (2006.01) |
| ***D06F 39/00*** | (2006.01) |
| ***D06F 37/02*** | (2006.01) |

(52) U.S. Cl.

CPC ..... *D06F 37/00* (2013.01); *D06F 39/00* (2013.01); *D06F 39/12* (2013.01); *D06F 35/008* (2013.01); *D06F 37/02* (2013.01)

(58) Field of Classification Search

CPC ..... D06F 35/00; D06F 39/12; D06F 39/00
USPC ..... 68/3 R, 13 R, 139, 142
See application file for complete search history.

(56) References Cited

U.S. PATENT DOCUMENTS

| | | | | |
|---|---|---|---|---|
| 4,110,034 A | 8/1978 | Suzuki | | |
| 7,886,563 B2 * | 2/2011 | Komori et al. | ..... | 68/18 F |
| 8,656,745 B2 * | 2/2014 | Kim et al. | ..... | 68/20 |

FOREIGN PATENT DOCUMENTS

| | | | | |
|---|---|---|---|---|
| CN | 2176376 | | 9/1994 | |
| CN | 101537417 | | 9/2009 | |
| CN | 201447585 U | * | 5/2010 | |
| GB | 1237431 | | 6/1971 | |
| GB | 1462764 | | 1/1977 | |
| JP | 2004073784 A | * | 3/2004 | ..... D06F 35/00 |
| JP | 2004141587 A | * | 5/2004 | ..... D06F 39/00 |
| KR | 200128798 Y1 | * | 10/2006 | ..... D06F 39/00 |
| KR | 1020090023804 | | 3/2009 | |

OTHER PUBLICATIONS

Machine translation of JP 2004141587 A, published May 2004.*
Machine translation of CN 201447585 U, published May 2010.*
Machine translation of KR 200128798 Y1, published Oct. 2006.*

* cited by examiner

*Primary Examiner* — Joseph L Perrin
(74) *Attorney, Agent, or Firm* — Dicke, Billig & Czaja, PLLC

(57) ABSTRACT

One aspect is a brush system for a washing machine including a plurality of independent brush sets. Each independent brush set is configured to be inserted into a single hole formed in a drum of the washing machine. Each brush independent set includes a plurality of bristles contained within a holder. Each holder is secured adjacent the hole formed in the drum of the washing machine such that the plurality of bristles projects out from the drum and toward a surface to be cleaned.

15 Claims, 11 Drawing Sheets

WASHING MACHINE BRUSH SYSTEM AND METHOD

BACKGROUND

Commercial and residential washing machines typically include an inner and outer drum. The inner drum will hold the clothes and will rotate within the outer drum, thereby agitating the clothes during a wash cycle. The outer drum is essentially a tub that holds the water and detergent during the wash cycle. Water is removed by a pump and in the area between the inner and outer drum will remain moist even after the water is pumped out. This area between the inner and outer drum will continue to build up mold, mildew and residue from detergent and other contaminants as part of the ongoing wash cycles. There is potential for growth of this mold and mildew eventually leading to odor that can become overpowering. In some instances, this area must be cleaned.

In some current systems, removal of mold, mildew and other contaminants is accomplished through chemical means. These are costly solutions that must be applied periodically resulting in significant expense. In addition, the chemicals used will be transferred to municipal water treatment facilities and beyond and are not environmentally focused. For these and other reasons, there is a need for the present invention.

SUMMARY

One aspect is a brush system for a washing machine. The brush system includes a plurality of independent brush sets, each brush set configured to be inserted into a hole formed in a drum of the washing machine. Each brush set comprises a plurality of bristles contained within a brush base. Each brush base fits adjacent a hole formed in the drum of the washing machine such that the plurality of bristles projects out from the drum and toward a surface to be cleaned.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Figure 1:
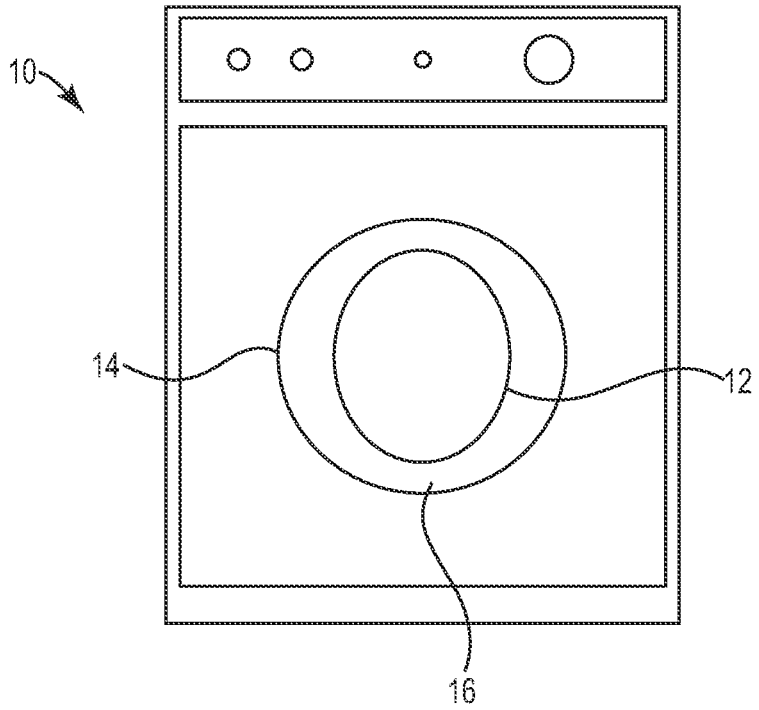
FIG. 1 illustrates a washing machine with an inner and outer drum.

FIG. 1 illustrates a washing machine 10, which can be configured with a brush system 20 (illustrated in FIG. 2) in accordance with one embodiment. Washing machine 10 includes an inner drum 12, which is configured to rotate within an outer drum 14. Inner drum 12 has a smaller diameter than outer drum 14 thereby defining drum cavity 16 between them.

In operation, clothes or material to be washed is inserted in inner drum 12, and then inner drum 12 will rotate within outer drum 14 and agitate the clothes during a wash cycle. Outer drum 14 holds water and detergent during the wash cycle, such that it is introduced into drum cavity 16 and into inner drum 12. Water is removed from inner and outer drums 12 and 14 by a pump.

After a wash cycle of washing machine 10, it is possible that drum cavity 16 will remain moist even after most of the water is removed, such that mold, mildew and residue from detergent and other contaminants can build up in drum cavity 16 over time. In one embodiment, brush system 20 is configured in washing machine 10 such that brush system 20 removes some or most of the deposits in drum cavity 16.

Figure 2:
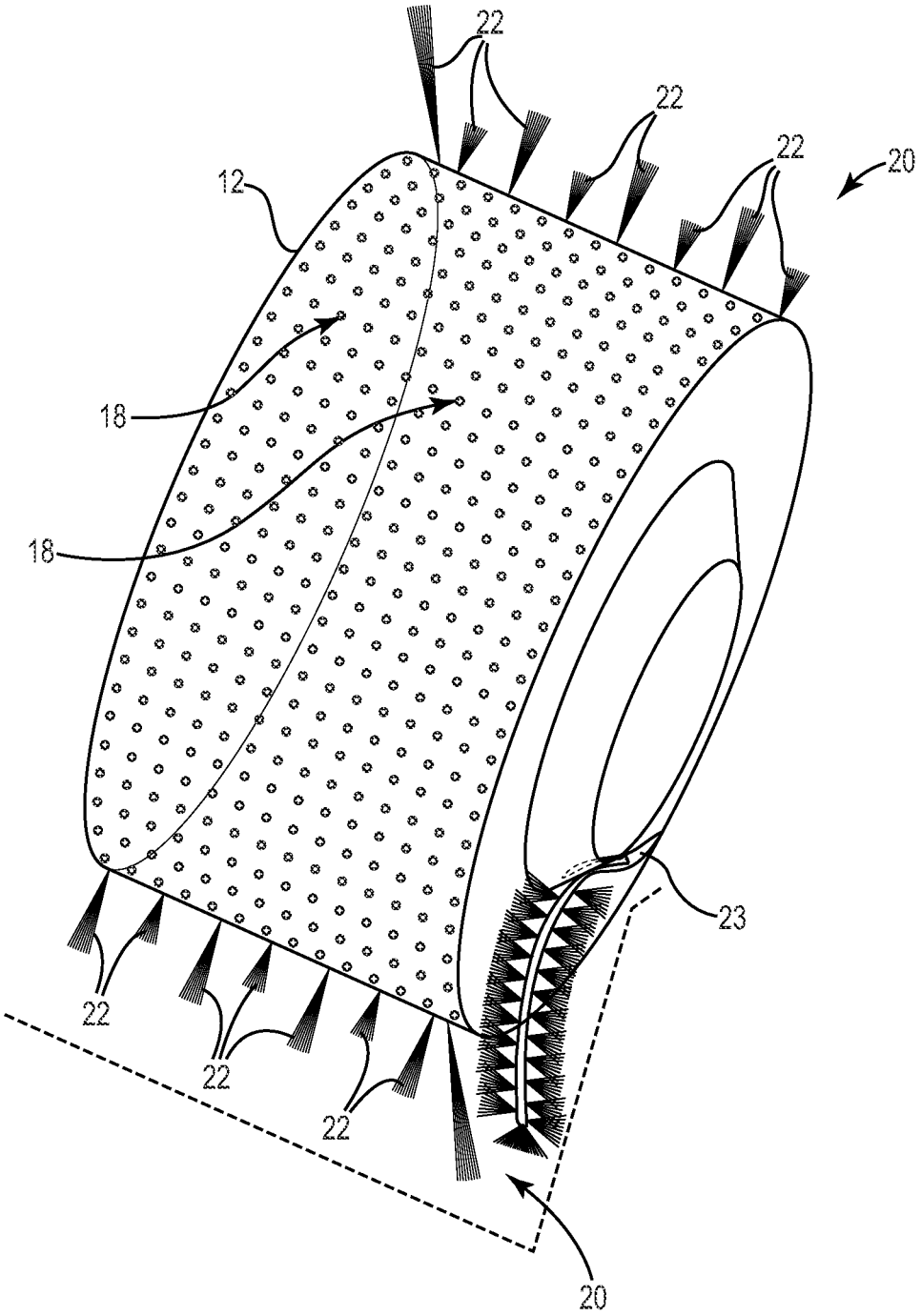
FIG. 2 is perspective view illustrating an inner drum with a brush system in accordance with one embodiment.

FIG. 2 illustrates inner drum 12 removed from washing machine 10 (for illustration purposes) and configured with a brush system 20 in accordance with one embodiment. A portion of the outer drum 14 is illustrated in dashed lines at the bottom of the figure. In one embodiment, brush system 20 includes a plurality of brush sets 22. In one example, each of brush sets 22 are inserted through drum holes 18 that are provided in inner drum 12. In most instances, drum holes 18 are provided in inner drum 12 to allow water and detergent to flow in and out of inner drum 12 in accordance with the wash cycle of washing machine 10.

In accordance with one embodiment, a plurality of brush sets 22 is inserted into a plurality of drum holes 18 in inner drum 12 such that each penetrate into drum cavity 16. When inner drum 12 rotates within outer drum 14 with brush sets 22 in place, brush sets 22 are adapted to clean surfaces within drum cavity 16 and remove deposits.

In one embodiment, the size and orientation of brush sets 22 can be varied to ensure cleaning of surfaces within drum cavity 16. As illustrated in FIG. 2, some brush sets 22 are angled relative to the surface of inner drum 12 and are used toward the edges of inner drum 12 such that they can clean sidewall surfaces. Other brush sets 22 are oriented substantially perpendicular to the surface of inner drum 12 and have differing brush lengths to form an alternating medium and short pattern throughout the center area of inner drum 12. Each of brush sets 22 are configured to have bristles that penetrate through a hole in drum 12 and clean surfaces in drum cavity 16 with rotation of the drum.

Furthermore, in one embodiment, sidewall brushes 23 can be installed on the side of inner drum 12 to further clean surfaces on that side. In one embodiment, sidewall brushes 23 are not attached through holes 18, but are instead attached to the sidewall of the drum and will sweep the front sidewall of the inner and outer drums 12 and 14. In one example, inner drum 12 includes a slight bevel around the opening, over which a slot in brush 23 can placed. Brush 23 is well configured to get brushes on surfaces that are otherwise hard to reach.

Figure 3:
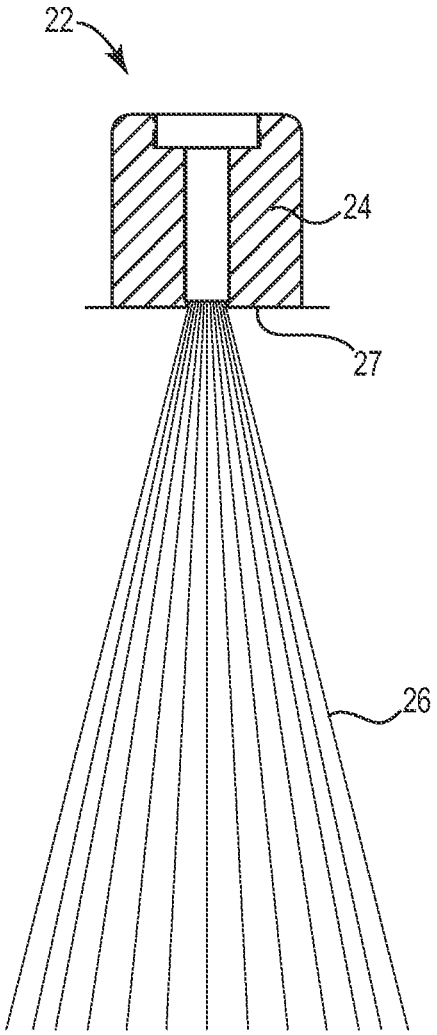
FIG. 3 illustrates a brush set for a brush system in accordance with one embodiment.

FIG. 3 illustrates brush set 22 in accordance with one embodiment. Brush set 22 includes base 24 and bristles 26. In one embodiment, brush set 22 is configured such that base 24 fits snugly against inner drum 12 adjacent a drum hole 18 such that bristles 26 penetrate into drum cavity 16 and extend against a surface of outer drum 14. As such, when brush sets 22 are attached to inner drum 12 in operation, the drum rotation will cause bristles 26 to brush a surface of outer drum 14, thereby cleaning away deposits and residue.

In one embodiment, base 24 has a contact surface 27 that is configured to be immediately proximate to the surface of inner drum 12 when base 24 in installed onto inner drum 12. In one embodiment, base 24 is further configured with an adhesive along contact surface 27 such that base 24 will stick to inner drum 12 and ensure that brush set 22 will not easily fall off during the rotation of inner drum 12.

Figure 4A:
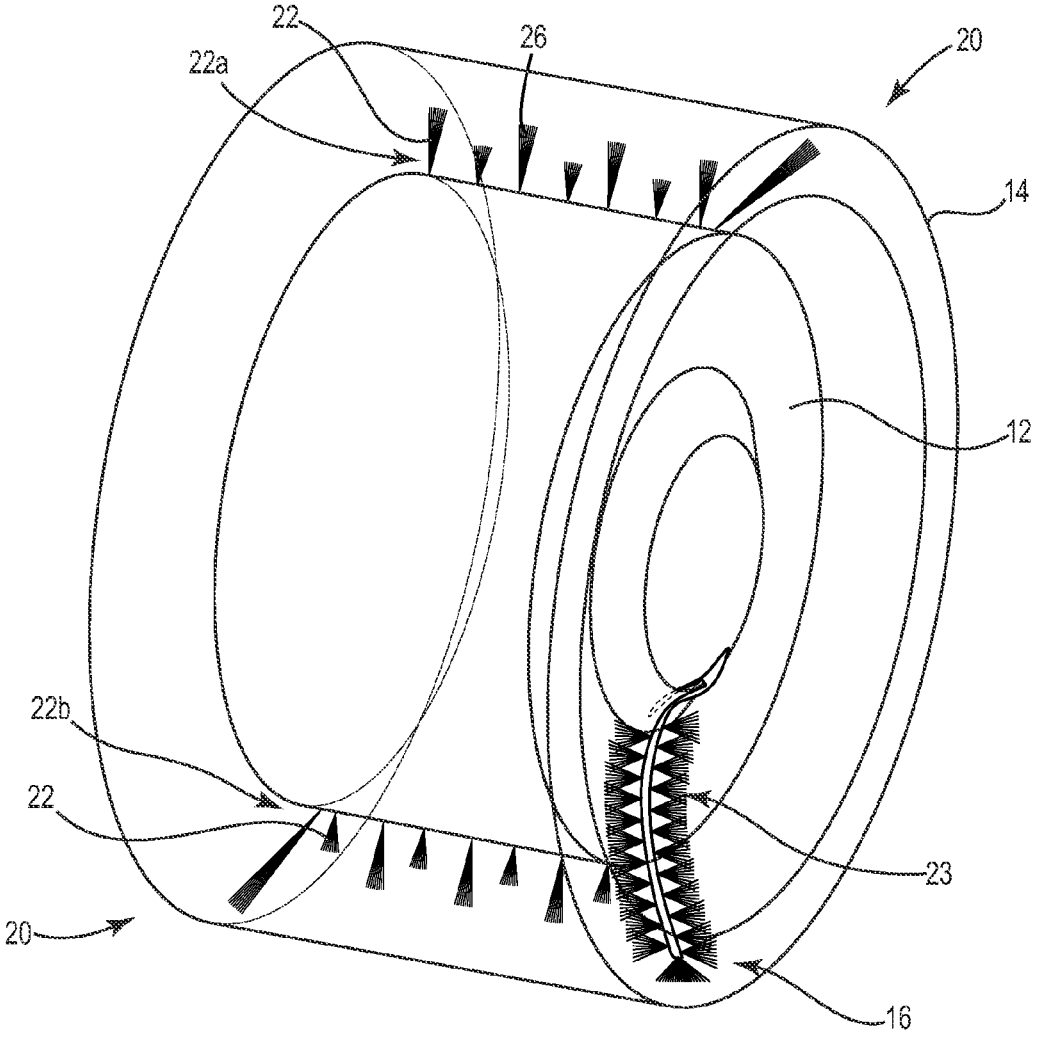
FIGS. 4*a*-4*b* are perspective views illustrating an inner and an outer drum with a brush system in accordance with one embodiment.
Figure 4B:
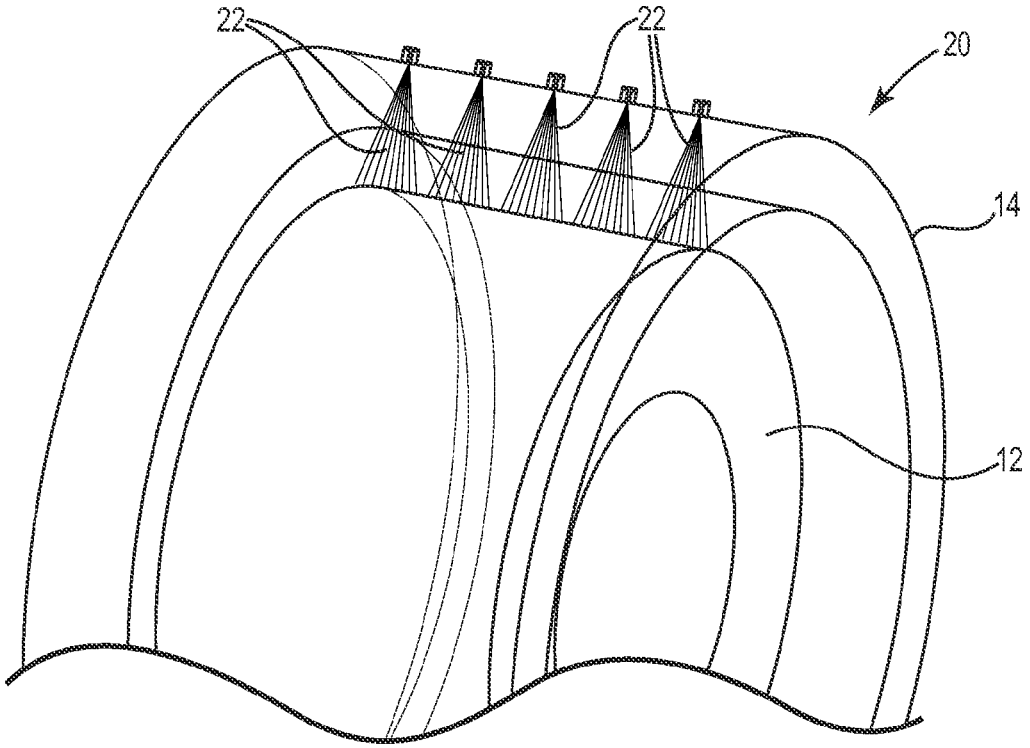

FIGS. 4*a*-4*b* illustrate inner drum 12 within outer drum 14 with washing machine 10 removed for illustration purposes (drum holes 18 are also removed from the figure to simplify the illustration). Drums 12 and 14 are configured with a brush system 20 in accordance with one embodiment. Brush system 20 includes a plurality of brush sets 22 inserted through drum holes 18 (illustrated in FIG. 2) provided in inner drum 12.

In one embodiment illustrated in FIG. 4*a*, individual brush sets 22 are added to inner drum 12 and project up to clean the surface of outer drum 14. In one embodiment, individual brush sets 22 are inserted across the width of inner drum 12 in a first row 22*a* and a second row 22*b*. In one embodiment, first row 22*a* is offset 180 degrees relative to second row 22*b* (that is, first row 22*a* is at the "top" when second row 22*b* is at the "bottom") in order to limit any impact or contribution to imbalance of inner drum 12. In another embodiment illustrated in FIG. 4*b*, individual brush sets 22 are added to outer drum 14 and project down to clean the surface of inner drum 14.

In addition, in one embodiment, the length of bristles 26 for each of the brush sets 22 is varied. For example, in one embodiment, long and short lengths for bristles 26 are alternated across the width of inner drum 12. In one example, an opposite order is used for the first 22*a* and second rows 22*b* of brush sets 22, such that if long bristles 26 are used on the first brush set 22 in first row 22*a*, then short bristles 26 are used on the first brush set 22 in the second row 22*b*, which is 180 degrees offset from it. Each next brush set 22 in each row then alternates in bristle length with the next adjacent brush set 22. In other embodiments, other variations of length and patterns are used.

The independent brush design of brush sets 22 is unique in that they can be custom arranged in inner drum 12. In one embodiment, brush sets 22 are easily distributed across inner drum 12 and offset any weight imbalance caused by their addition, thereby resulting in nearly no vibration during the rotation of inner drum 12 within outer drum 14 while brush system 20 is in place during operation of washing machine 10. Such independence and balance is not achieved, for example, where a single brush assembly with a series of bristles is installed across the entire width of a drum. Also, with such a single brush assembly, there is no way to easily develop a universal pattern that will meet the hole pattern requirements of all existing drums. Using a one-to-one correspondence between each brush set 22 and each drum hole 18 of inner drum 12 allows for this independent arrangement of brushes and ease of weight distribution and balance.

In another embodiment, brush sets 22 are configured to be so small and light that their addition to inner drum 12 will not contribute significantly to any weight imbalance. In such an embodiment, there would be no need to use any particular pattern to installing brush sets 22 across inner drum 12.

Figure 5A:
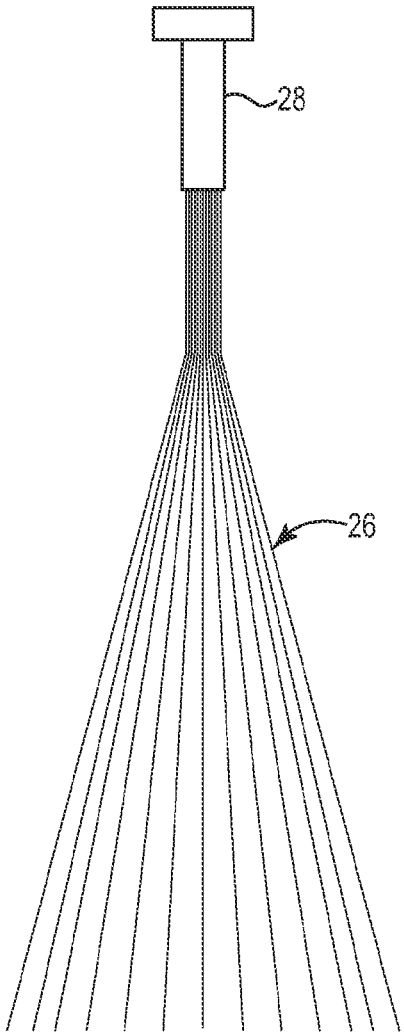
FIGS. 5*a*-5*b* illustrate portions of a brush set for a brush system in accordance with one embodiment.
Figure 5B:
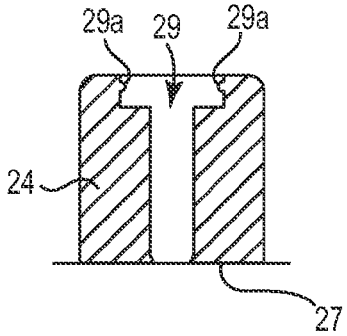

FIGS. 5*a*-5*b* together illustrate brush set 22 in accordance with one embodiment. In one example, brush set 22 includes base 24, bristles 26 and bristle holder 28, and FIG. 5*a* illustrates bristles 26 and bristle holder 28, while FIG. 5*b* illustrates base 24. In one embodiment, bristles 26 and bristle holder 28 are formed into a unitary piece. In various embodiments, bristles 26 are made of nylon, plastic, metals, various composites thereof, or any of a variety of relatively stiff materials. In one embodiment, bristle holder 28 is formed over bristles 26 and holds them together.

Base 24 is configured with a base cavity 29 for receiving bristle holder 28, and in one embodiment, its shape complements the shape of holder 28. Base 24 has a contact surface 27 that can be glued or otherwise fixed to inner drum 12. The combination of bristles 26 and bristle holder 28 can be inserted through base cavity 29 of base 24, after contact surface 27 of base 24 is adhered to a drum. In various embodiments, base 24 is a rigid or semi-rigid rubber or plastic material.

In one embodiment, bristle holder 28 is shaped to complement the shape of base cavity 29 such that when bristle holder 28 is inserted into base cavity 29 there is a slight interference between bristle holder 28 and base 24 so that bristle holder 28 will not easily dislodge therefrom. As such, even during a wash cycle bristle holder 28 and bristles 26 will be held firmly in place by base 24. In one embodiment, projections 29*a* are added to base cavity 29 and are configured to further engage bristle holder 28 once inserted. These can further ensure that bristles 26 will not move once inserted. Alternatively, or in addition, a cover or cap can be added to base 24 so that bristle holder 28 can be fully enclosed in base 24 once inserted.

In one embodiment, base 24 can be configured for multiple uses over many wash cycles of washing machine 10, while bristles 26 will typically wear during use and may have a shorter useful lifespan. As such, new bristles 26 and bristle holder 28 can be easily inserted into base 24, which can be re-used in some embodiments. In one embodiment, contact surface 27 of base 24 is fitted with an adhesive that will hold up over many wash cycles of washing machine 10. As such, base 24 can be left in place even after bristle holder 28 and bristles 26 are removed, thereby exposing hole 18 in drum 12 for normal wash cycle operation.

Figure 6A:
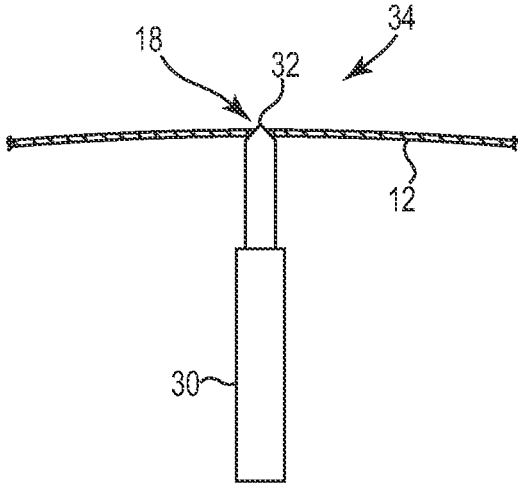
FIGS. 6*a*-6*d* illustrate a sequence for the assembly of a brush set in accordance with one embodiment.

FIGS. 6*a*-6*d* illustrate the assembly of a brush set 22 into inner drum 12. In FIG. 6*a*, alignment tool 30 is illustrated centered on a drum hole 18 in inner drum 12. In one embodiment, alignment tool 30 has a pointed end 32 configured to fit into hole 18 thereby centering alignment tool 30 on hole 18. Furthermore, alignment tool 30 has a lower section 34 that is generally shaped to receive base 24 (which is not shown in FIG. 6*a* to better illustrate tool 30). In one example, the shape of lower section 34 of alignment tool 30 substantially complements the shape of base cavity 29 of base 24.

Figure 6B:
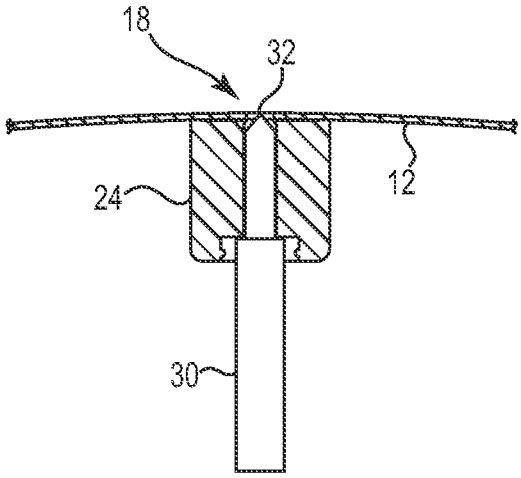

In FIG. 6*b*, base 24 is illustrated with alignment tool 30 extending through it. In the illustration, base 24 is shown in cross-section so that alignment tool 30 remains visible in the area passing though base 24. In one embodiment, lower section 34 of alignment tool 30 fits snuggly into base 24 such that base 24 is aligned over hole 18 along with alignment tool 30. In one embodiment, contact surface 27 of base 24, which is adjacent inner drum 12, has an adhesive on it such that base 24 will be secured in this centered position over hole 18 even after alignment tool 30 is removed.

Figure 6C:
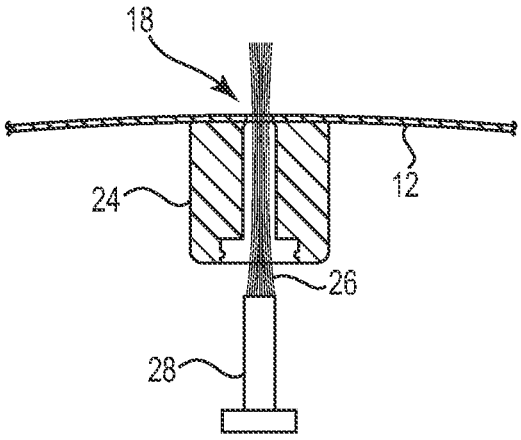
Figure 6D:
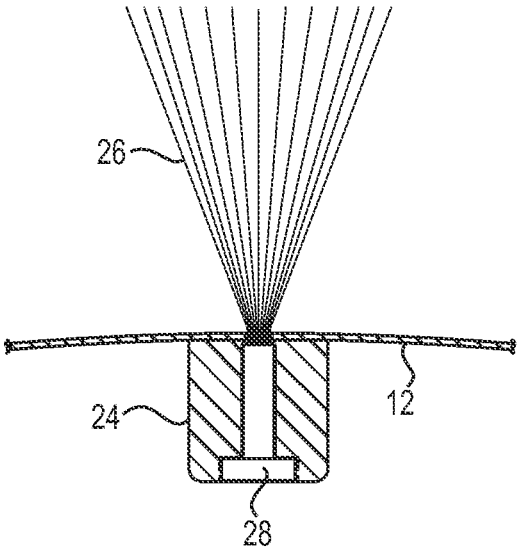

In FIG. 6*c*, alignment tool 30 is removed from base 24 and bristles 26 and bristle holder 28 are being inserted through base 24 and hole 18. In one embodiment, base 24 has a partially stepped base cavity 29 that is configured to receive bristle holder 28 once it is fully inserted. In one embodiment, projections 29*a* are provided on portions of base cavity 29 to ensure bristle holder 28 is firmly retained in base 24. FIG. 6*d* illustrates bristle holder 28 fully inserted into base 24 such that bristles 26 extend through drum hole 18 in inner drum 12 toward outer drum 14.

Figure 7:
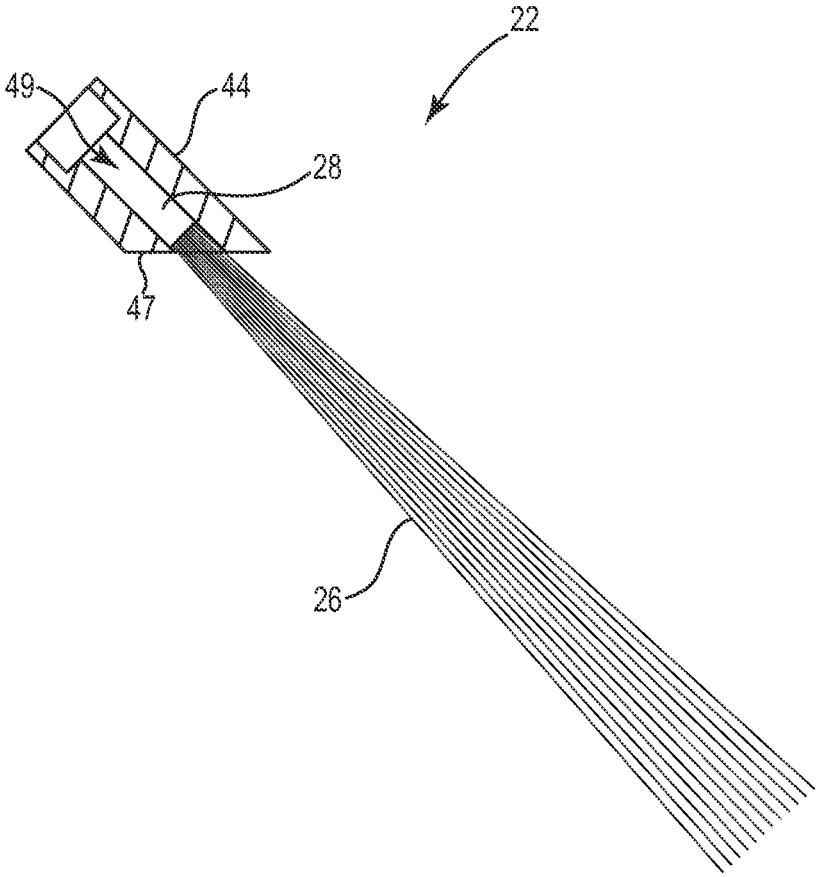
FIG. 7 illustrates a brush set for a brush system in accordance with one embodiment.

FIG. 7 illustrates brush set 22 in accordance with one embodiment. Brush set 22 includes base 44, bristle holder 28 and bristles 26. In one embodiment, brush set 22 is configured such that base 44 fits snugly against inner drum 12 adjacent a drum hole 18 such that bristles 26 penetrate into drum cavity 16 and extend against outer drum 14. As such, when brush sets 22 are inserted into inner drum 12 in operation, the drum rotation will cause bristles 26 to brush the inner surface of outer drum 14, thereby cleaning away deposits and residue.

In addition, contact surface 47 of base 44 is angled relative to base cavity 49 into which bristle holder 28 is inserted. As such, when contact surface 47 is glued or otherwise secured to inner drum 12 about a hole 18, bristles 26 extend from inner drum 12 at an angle rather than perpendicular therefrom. FIG. 2 illustrates a variety of brush sets 22, some of which have a base 44 having a contact surface 47 that is substantially angled relative to inner drum 12 (those at the edges) and some of which have a base 24 having a contact surface 27 that is substantially perpendicular to inner drum 12 (those in between the ones on the edges). One skilled in the art understands that a variety of relative angles may be used to provide that bristles project from drum 12 is a variety of relative angles, in order to best optimize their ability to clean.

In one embodiment, bristle holder 28 and bristles 26 can be configured to be universal relative to base 24 and base 44. In other words, the same bristle set, that is, combination of bristle holder 28 and bristles 26, could be used in either a base with an angled cavity to contact surface relationship, such as base 44, or a base with a substantially perpendicular cavity to contact surface relationship, such as base 24.

In other embodiments, there are various modifications to brush system 20. For example, brush system 20 is described above with respect to individual brush sets 22 being inserted through holes in inner drum 12 out toward outer drum 14. In a very similar fashion, brush system 20 can include individual brush sets 22 being inserted through holes in outer drum 14 in toward inner drum 12. In typical washing machine applications, although drum holes 18 are often provided in the inner drum 12, holes are not typically provided in outer drum 14. As such, in some instances, holes may be added to either or both of drums 12 and 14 by drilling into the drums so that brush sets can be added. As such, surfaces within drum cavity 16 may be accesses and cleaned with brush system 20 by inserting brush set 22 through outer drum 14 to cavity 16, into inner drum 12 to cavity 16, or a combination thereof.

Figure 8A:
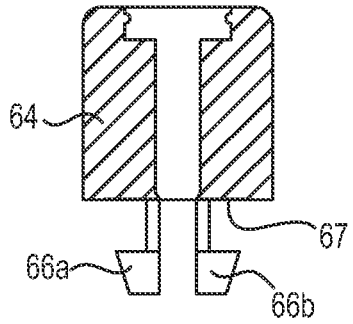
FIGS. 8*a*-8*b* illustrates a base for a brush set in accordance with one embodiment.
Figure 8B:
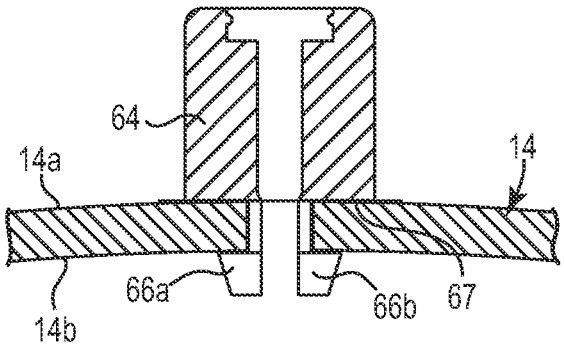

FIGS. 8*a*-8*b* illustrate an alternative base 64, which can be used in a brush system 20 in accordance with one embodiment. In one embodiment, either or both of drums 12 and 14 are drilled into to create holes 18 in the drums. Once these holes 18 are added, base 64 is inserted into the holes. Base 64 is similar to base 24 described above, but base 64 additionally includes base clips 66*a* and 66*b*. In one embodiment, base clips 66*a* and 66*b* are angled in part so that they are easily insertable through a hole 18 from a first surface 14*a* of drum 14. Once fully inserted therethrough, base clips 66*a* and 66*b* will lock against a second surface 14*b* of drum 14 that is opposite the first surface. As such, in one embodiment, base 64 remains in place and is not removed.

Once in place, base 64 functions similarly to base 24 and 64 above. As such, bristle holder 28 and bristles 26 can be configured to be universal relative to base 24, base 44 and base 64. In other words, the same bristle set, that is, combination of bristle holder 28 and bristles 26, could be used in any of these bases.

Because base 64 allows installation in any custom-drilled hole, brush system 20 using base 64 can be installed into virtually any type of washing machine, including a front load, a top load, a commercial or a residential machine.

Figure 9:
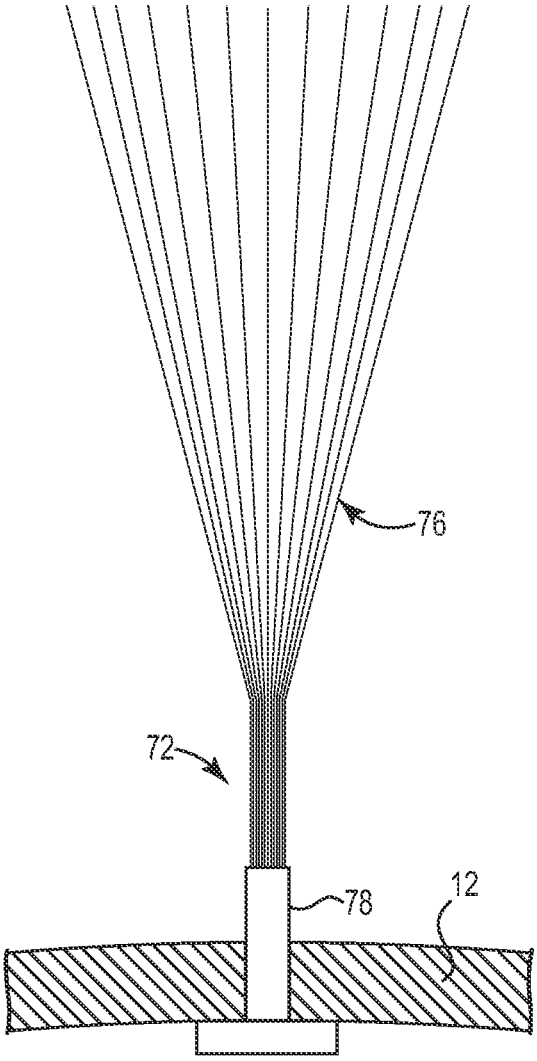
FIG. 9 illustrates a brush set for a brush system in accordance with one embodiment.

FIG. 9 illustrates a brush set 72 installed into inner drum 12 in accordance with one embodiment. In one embodiment, brush set 72 includes an integrated base and bristle holder 78 and bristles 76. In one embodiment, holder 78 is formed over bristles 76 and holds them together. Brush set 72 is inserted through a hole 18 in inner drum 12. In one embodiment, a lower surface 77 of holder 78 is adhered to the drum 12 with an adhesive. Bristles 76 projection from the drum then clean adjacent surfaces as described above with the other embodiments. Because integrated base and bristle holder 78 has a integrated base in one embodiment, there is no need for a separate base, such as base 24 above.

Figure 10A:
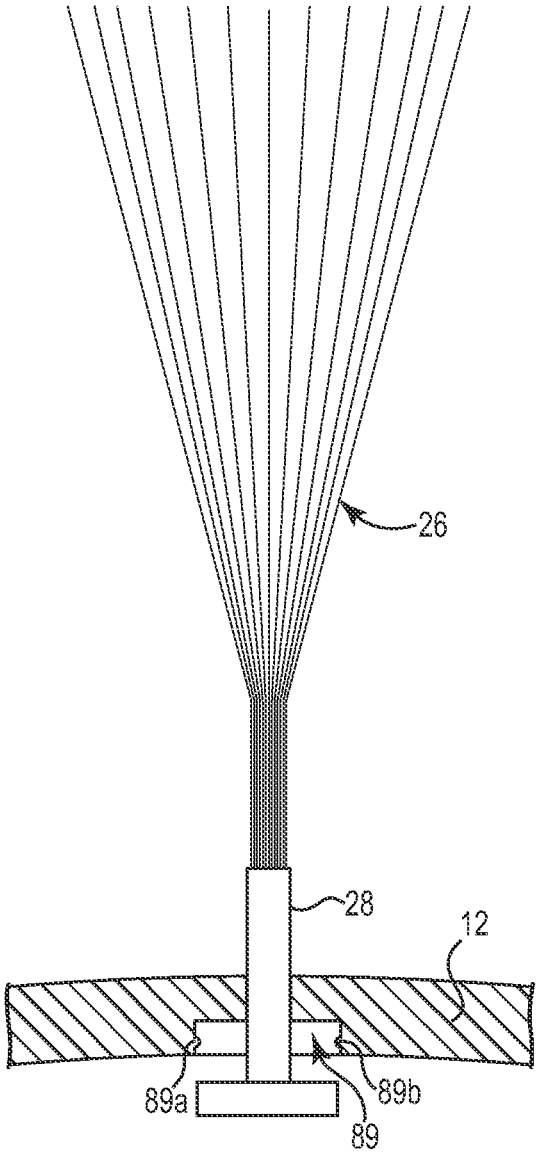
FIGS. 10*a*-10*b* illustrates brush sets for a brush system in accordance with one embodiment.
Figure 10B:
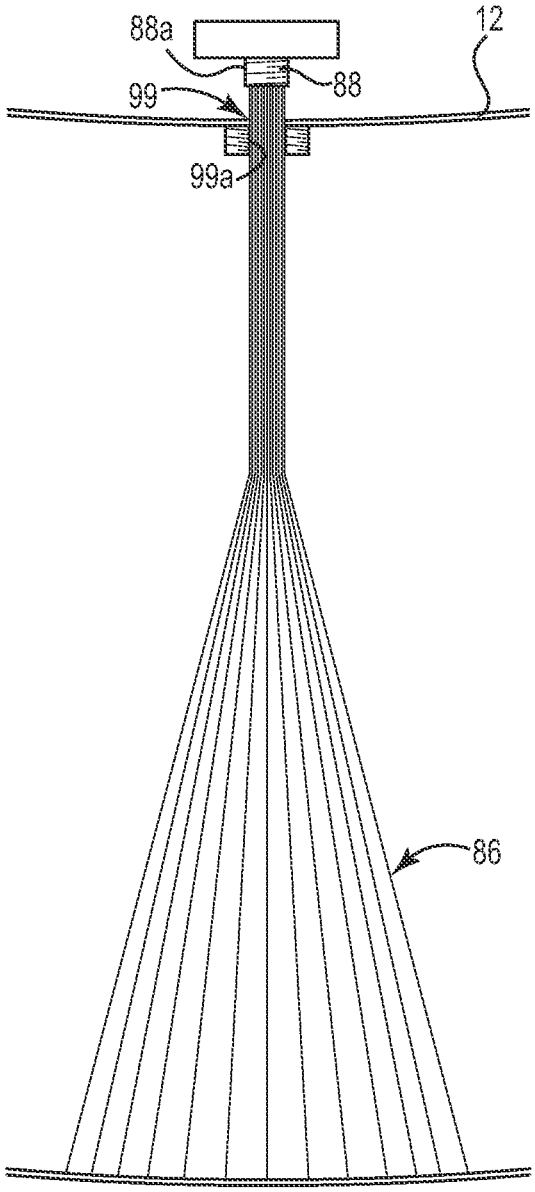

FIGS. 10*a*-10*b* illustrate further embodiments used with brush system 20. FIG. 10*a* illustrates a cavity 89 formed in an inner drum 12. In one embodiment, cavity 89 is configured for receiving a bristle holder 28, similar to bristle holder 28 in FIG. 5*a*, and in one embodiment, the shape of cavity 89 complements the shape of bristle holder 28. As such, the combination of bristles 26 and bristle holder 28 can be inserted through cavity 89 of inner drum 12 to form a brush set. In effect, such a brush set has a base (such as base 24 above) integrated into inner drum 12 so that no additional base 24 is needed. In one embodiment, projections 89*a* are added to cavity 89 and are configured to further engage bristle holder 28 once inserted. These can further ensure that bristles 26 will not move once inserted. Alternatively, or in addition, a cover or cap can be added.

FIG. 10*b* illustrates a threaded attachment 99 formed adjacent a hole on inner drum 12. In one embodiment, threaded attachment 99 is configured for receiving a bristle holder 88, similar to bristle holder 28 in FIG. 5*a*. In one embodiment, bristle holder 88 includes threads 88*a*, which are configured to be screwed into threads 99*a* of threaded attachment 99. This will firmly seat bristle holder 88 against inner drum 14 such that bristles 96 will extend out to outer drum 14 (a portion of which is illustrated at the bottom of the figure).

Once bristle holder 88 is screwed into threaded attachment 99, this ensures that bristles 86 will not move once inserted.

In one embodiment, brush system 20 could be sold with or installed in a new washing machine. In another embodiment, brush system 20 is sold as a kit that can be used on an existing washing machine 10. As such, a user that has a washing machine 10 that is exhibiting signs of build up or mildew in a drum cavity 16 can purchase a brush system kit and add it to the washer.

In one example, a brush system kit includes fourteen perpendicular bases 24, two angled bases 44, one alignment tool 30, seven 1.5 inch long bristles 26 (as measured from the top of bristle holder 28 to the end if the bristles 26), seven 2.5 inch long bristles 26, two 5 inch long bristles 26, and a sidewall brush 23. Each independent brush set 22 can then be installed in the inner drum 12 (as described relative to FIGS. 6*a*-6*d* above) and arranged to easily offset any weight distribution and result in nearly no vibration.

For example, with such a kit, brush sets 22 can be installed as follows:

- two angled bases installed on the ends, with one 5" long bristles set installed on the end of the top of the inner drum and one 5" long bristles set installed on the end of the opposing end of the bottom of the inner drum;
- seven perpendicular bases installed on the top of the inner drum, with four 2.5" long bristles sets alternating with three 1.5" long bristles sets; and
- seven perpendicular bases installed on the bottom of the inner drum, with three 2.5" long bristles sets alternating with four 1.5" long bristles sets.

In addition to these independent brush sets 22, a sidewall brush 23 is provided to reach the front sidewall of the drum. In one embodiment, sidewall brush 23 is intended to be used as a hand brush, and in another embodiment it can be seated firmly on the rim of the inner drum 12.

The above-described exemplary kit is generally illustrated in FIG. 2, for example. The actual diameter of brush sets 22 and overall length of brushes 26 will vary from application to application. In some examples, washing machines have holes in inner drum 12 that are approximately 0.147 inches in diameter, but in other washers this will vary from model to manufacturer. As such, brush sets 22 can be designed to fit existing machines and their various known sizes. In another embodiment, brush sets 22 can be sold as a one size and the user can be provided with a drill bit to drill holes that will fit with the provided size of brush set.

Furthermore, the distance between the inner and outer drums 12 and 14 will vary from model to manufacturer. As such, the particular length of the bristles 26 installed in any brush set 22 can be varied to match the application into which it is installed. In one embodiment, the user can be provided with longer bristles 26 that are to be cut down to the appropriate size dependent on the particular machine on which it will be used.

In accordance with one embodiment, brush system 20 cleans a washing machine and extends its useful life. Brush system 20 provides a physical means to remove the unwanted residue from within a washing machine. Brush system 20, using an independent brush design can be combined with a mild detergent and bleach solution, to overcome most of the mold, mildew and other deposits that naturally occur in a washing machine.

As such, in some embodiments, brush system 20 may offer a significant reduction in the odors associated with unwanted residue. It can also be easy to install, even in after market applications, and yet does not require any disassembly of the washing machine and still removes the undesirable odor and contaminates from the outer drum. It can be installed by an average homeowner without professional assistance and without complications. Brush system 20 includes an independent brush design that is useful for any model of washing machine. It can be particularly useful for people who have heightened sensitivity to mold, mildew and other allergens.

The particular use of brush system 20 can vary in accordance with certain factors. For example, the frequency with which brush system 20 is implemented and used in a washing machine may depend on the frequency of use of the washing machine, the water supply (e.g., well or city water), hard or soft water, types of detergents used for regular laundering, contaminants being washed from clothing, and climate, among others.

In one embodiment, brush system 20 can be used on a semi-annual basis. In one example, directions for the system 20 can be provided to a user, especially where it is offered as a kit. One example set of instructions includes the following steps:

1. Ensure the machine is off and not in a wash cycle.
2. Open door of washing machine to access the inner drum.
3. With the inner drum dry and clean from debris, wipe down the inner drum with a paper towel.
4. Use an angled base at the bottom (or rear) of the inner drum.
   a. Remove adhesive protector to expose adhesive.
   b. Use alignment tool provided to guide the base over the selected hole in the end of the drum.
   c. Affix the base to the inner drum so the brush set is pointed away.
5. Install a perpendicular base (skipping 2 holes between each base) on the row of holes on the bottom of the inner drum, working toward you.
   a. Remove adhesive protector and use alignment tool to affix remaining 7 bases to the bottom of the inner drum.
6. Use an angled base at the top (or front) of the inner drum.
   a. Remove adhesive protector to expose adhesive.
   b. Use alignment tool provided to guide the base over the selected hole in the end of the drum.
   c. Affix the base to the inner drum so the brush set is pointed away.
7. Install a perpendicular base (skipping 2 holes between each base) on the row of holes on the top of the inner drum, working toward you.
   a. Remove adhesive protector and use alignment tool to affix remaining 7 bases to the top of the inner drum.
8. Install the long (5") brush set in the angled bases.
   a. * Note* It is easier to install the brush set if you gently move the inner drum back and forth (approximately 1") while inserting brush set into the base.
9. Insert the medium (2.5") brush sets in every other base on the bottom and top row of bases.
10. Insert the short (1.5") brush sets in the remaining bases that are not yet populated.
11. Ensure the cover to each base is properly secured.
12. Ensure that the bases are properly secured to the inner drum and adhesive is holding well.
13. Add a small amount of detergent and a small amount of bleach into the appropriate dispensers (⅛ capful of detergent, and approximately the same amount of bleach)
14. Machine settings: Close door or cover and select the quick wash setting, if quick wash is not available, select delicate cycle. Select a hot wash cycle and low spin.
15. Select the spin setting as low.

16. Do not load clothing into the machine, particles and contaminants will be removed from the walls of the outer drum and will contaminate clothes. This wash cycle will have no clothing in it.

17. Allow machine to complete a wash cycle.

18. Once the cycle is complete simply open the door or cover and hold the base unit to gently remove the brush set from the inner drum.

19. Ensure no adhesive deposits are remaining in the inner drum; remove any that are remaining with a rolling action of a finger.

20. Wash cycle is complete.

21. Discard brush sets and retain the base units.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A brush system for a washing machine comprising:

a plurality of independent brush sets, each independent brush set configured to be inserted into a single hole formed in a drum of the washing machine;

wherein each independent brush set comprises a plurality of bristles contained within a holder and further comprises a brush base that is configured to receive the holder;

wherein the brush base is secured adjacent the single hole such that the plurality of bristles projects through the hole from the drum and toward a surface to be cleaned when the plurality of bristles contained within the holder are inserted into the brush base; and wherein each brush set is configured such that the plurality of bristles contained within the holder are removable from the brush base such that the brush base exposes the hole in the drum allowing for a normal wash cycle of the washing machine even while the brush base remains secured adjacent the hole.

2. The brush system of claim 1, wherein each brush base is secured to the drum with one of either an adhesive or clips such that it will not fall out during a regular wash cycle of washing machine and configured to allow the plurality of bristles contained within the holder to be easily removed from the brush base.

3. The brush system of claim 1, wherein the brush base includes a feature that secures the brush base to the holder when the holder is inserted into the brush base, and allows the holder to be easily removed from the brush base.

4. The brush system of claim 1, further comprising an alignment tool configured to align the brush base with the hole in the drum.

5. The brush system of claim 1, wherein the brush base comprises a base cavity substantially aligned with the holder in the drum and through which the holder extends.

6. The brush system of claim 5, wherein the brush base has a surface adjacent the drum that is substantially perpendicular relative to the base cavity such the plurality of bristles projects out from the drum substantially perpendicular relative to drum surface.

7. The brush system of claim 5, wherein the brush base has a surface adjacent the drum that is substantially angled relative to the base cavity such the plurality of bristles projects out from the drum at an angle relative to drum surface.

8. The brush system of claim 1, wherein the plurality of brush sets are configured across an entire width of the drum of the washing machine to substantially clean across the width of the washer.

9. The brush system of claim 1, wherein the plurality of brush sets are configured across width in uniform manner to balance weight of brush sets, and wherein the length of the bristles for at least some of the plurality of brush sets is varied from set to set.

10. The brush system of claim 1, wherein the plurality of brush sets are inserted in an outer drum of the washing machine and extend in toward an inner drum of the washing machine.

11. The brush system of claim 1, wherein the plurality of brush sets are inserted in an inner drum of the washing machine and extend out toward an outer drum of the washing machine.

12. The brush system of claim 1, wherein the brush set is inserted through a hole in the drum that is pre-existing in the drum of the washing machine.

13. The brush system of claim 1, wherein the holder of the brush set is configured with threads that are screwed into corresponding threads provided adjacent the hole such that the brush set is secured to the drum of the washing machine.

14. The brush system of claim 1 further comprising a sidewall brush configured to be inserted into a sidewall of the drum and to sweep a front sidewall between an inner and an outer drum.

15. A brush system for a washing machine comprising:

a plurality of independent brush sets, each independent brush set configured to be inserted into a single hole formed in a drum of the washing machine;

wherein each independent brush set comprises a brush base and a plurality of bristles contained within a holder that is configured to be inserted into the brush base;

wherein the brush base comprises clips configured to extend through the single hole such that the brush base is locked against the drum of the washing machine by the clips;

wherein the plurality of bristles projects through the hole from the drum and toward a surface to be cleaned when the plurality of bristles contained within the holder are inserted into the brush base; and wherein each brush set is configured such that the plurality of bristles contained within the holder are easily removable from the brush base such that the brush base exposes the hole in the drum allowing for a normal wash cycle of the washing machine even while the brush base remains secured adjacent the hole.

* * * * *